US006581229B2

(12) United States Patent
Bernstein

(10) Patent No.: US 6,581,229 B2
(45) Date of Patent: Jun. 24, 2003

(54) MODULAR MATERNITY MATTRESS SYSTEM

(76) Inventor: Glenn I. Bernstein, 624 Hill Dr., Brick, NJ (US) 08724

( * ) Notice: Subject to any disclaimer, the term of this patent is extended or adjusted under 35 U.S.C. 154(b) by 0 days.

(21) Appl. No.: 09/903,384

(22) Filed: Jul. 11, 2001

(65) Prior Publication Data

US 2002/0020022 A1 Feb. 21, 2002

Related U.S. Application Data

(60) Provisional application No. 60/217,792, filed on Jul. 12, 2000.

(51) Int. Cl.[7] ..... A47C 27/14
(52) U.S. Cl. ..... 5/722; 5/735; 5/930; 5/631
(58) Field of Search ..... 5/631, 695, 722, 5/724, 731, 735, 736, 930

(56) References Cited

U.S. PATENT DOCUMENTS 1,054,452 A * 2/1913 Sayen ..... 5/604
2,644,957 A * 7/1953 Shudde ..... 4/450
4,011,610 A * 3/1977 Parker, III ..... 5/604
4,021,872 A 5/1977 Powell
4,051,566 A 10/1977 Esquivel
4,603,445 A 8/1986 Spann
4,686,725 A 8/1987 Mitchell
5,369,824 A * 12/1994 Powell ..... 5/735
D411,933 S 7/1999 Bernstein

* cited by examiner

*Primary Examiner*—Michael F. Trettel
(74) *Attorney, Agent, or Firm*—Dority & Manning

(57) ABSTRACT

A mattress system constructed of synthetic foam is described especially for use as a maternity mattress. The mattress system has a main mattress portion with a specifically shaped central opening through the center thereof. At least two modular plugs have both a top and bottom that is generally flat but are in some embodiments textured and the curved peripheries thereof are smooth with a curvature to mate with the central opening of the main mattress portion. The modular plugs may be of different thicknesses and can be selectively removed and positioned to increase the depth of the opening for receipt of a woman's growing abdomen during pregnancy.

24 Claims, 5 Drawing Sheets

MODULAR MATERNITY MATTRESS SYSTEM

CROSS-REFERENCE TO RELATED APPLICATIONS

This application claims the benefit of U.S. Provisional Application No. 60/217,792, filed Jul. 12, 2000.

BACKGROUND OF THE INVENTION

The present invention generally relates to a mattress for a bed. More specifically, the present invention relates to a mattress having provision for accommodating the abdomen of a pregnant woman. Still further, the present invention relates to a mattress having a central opening with modular plugs for altering the depth of the central opening, which is capable of accommodating the abdomen of a pregnant woman.

Conventional mattresses are known and maternity mattresses per se are not new. U.S. Pat. No. 4,021,872, incorporated fully herein by reference, discloses a maternity mattress with a modifiable cavity for supporting the enlarged abdomen of a pregnant woman. The mattress comprises resilient disk-like members as filler means removably received in a circular cavity. The disk-like members, at least two concave mattress sections, can be selectively removed to alter the size of the circular cavity.

U.S. Pat. No. 4,051,566, incorporated fully herein by reference, discloses a mattress system with a modifiable cavity for supporting the abdomen of a pregnant woman. The mattress system comprises a mechanical undercarriage capable of raising and lowering a removable pad or pads through openings in both the mattress and box spring to generate a cavity for supporting a pregnant woman's enlarged abdomen.

While useful for its purpose, the '872 mattress utilizes a circular shaped cavity which does not conform to the more teardrop shape of a pregnant woman's growing abdomen. As a result, the cavity fails to provide proper support for the patient during use of the mattress. The '566 mattress system requires a complex mechanical system for raising and lowering the removable pads, as well as, openings completely through both the mattress and the box spring. This results in increased cost and complexity of the system in order to achieve a maternity mattress with an adjustable cavity. Additionally, the '872 and the '566 mattresses are mattress replacements and not supplements for use with other mattresses and neither provide any surface treatment for increased comfort of the patient.

It is, therefore, desirable to provide a simple, cost effective mattress supplement with a generally teardrop shaped central opening and two modular plugs removably received therein for selectively altering the depth of the central opening during the term of the pregnancy, where the upper and lower surfaces of the main mattress portion and the exterior surfaces of the modular plugs have a specific surface treatment to enhance the patient's comfort during use of the mattress.

SUMMARY OF THE INVENTION

The present invention recognizes and addresses various of the foregoing limitations and drawbacks, and others, concerning the cost, comfort, and adjustability of a maternity mattress. Therefore, the present invention provides a new maternity mattress with a generally teardrop shaped central opening and two modular plugs removably received therein for selectively altering the depth of the central opening during the term of the pregnancy. In addition, both the upper and lower surfaces of the main mattress portion and the exterior surfaces of the modular plugs have a specific surface treatment to enhance the comfort level of the patient while utilizing the mattress.

It is a principle object of the subject invention to provide a mattress system for use during a term of pregnancy. More particularly, it is a principle object of the present invention to provide a maternity mattress system that allows women to more comfortably sleep during the period of their pregnancy.

Another more particular object of the present invention is to provide a maternity mattress system capable of adequately supporting the enlarged abdomen of a pregnant woman while allowing her to rest in a prone position. In such context, it is an object of the present invention to provide a maternity mattress system with a central opening, which can be selectively altered in depth as desired for changing comfort by the patient over the term of a pregnancy.

It is a more general object of the present invention to provide a maternity mattress system, which has a specific surface treatment for increasing the comfort level of the patient. In such context, it is an object of the present invention to provide a foam maternity mattress system with a generally flat surface comprised of numerous discrete upstanding projections being independently compressible with voids between the projections.

It is still a further object of the present invention to provide a foam maternity mattress system with a specific surface treatment which has a central opening through the main mattress portion for receipt of at least two selectively removable modular plugs so as to allow for alteration of the depth of the central opening wherein the growing abdomen of a pregnant woman can be properly and comfortably supported while the woman rests in a prone position.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description).

These and other features, aspects and advantages of the present invention will become better understood with reference to the following description and appended claims. The accompanying drawings, which are incorporated in and constitute a part of this specification, illustrate an embodiment of the invention and, together with the description, serve to explain the principles of the invention.

One exemplary embodiment of the present invention includes a mattress system comprised of any of the numerous well-known synthetic foam materials. Such mattress system includes a main mattress portion sized for use by an individual with a central opening therein. Disposed within such main mattress portion central opening may be at least two selectively removable modular plugs whose curved peripheries may be smooth and have a curvature to mate with such main mattress portion's central opening.

The upper surface of such mattress system, including such inserted modular plugs, may have a surface treatment, which generates a uniform series of upstanding projections or promontories with a generally flat apex surface. Each individual promontory may be surrounded by voids, which allow for their individual compression. One of ordinary skill in the art will recognize that any suitable surface treatment, including no surface treatment at all, may be used with the present invention and either the upper or lower surfaces or both can be given such surface treatment.

Another exemplary embodiment of the present invention includes a mattress system comprised of any of the well-known synthetic foam materials. Such mattress system includes a main mattress portion sized for more than one person with an opening located centrally within one-half of such mattress portion. Such main mattress portion allows for the use of the mattress system on larger beds where the presence of a smaller mattress supplement could be awkward. Disposed within such main mattress portion central opening may be at least two selectively removable modular plugs whose curved peripheries may be smooth and have a curvature to mate with the main mattress portion's central opening.

A still further embodiment of the present subject matter concerns a maternity mattress suitable for a plurality of pregnant women. Such a maternity mattress may include a foam mattress supplement formed of any of the well-known synthetic foam materials and characterized by upper and lower surfaces, a defined thickness, and defining a plurality of openings therethrough. Such openings may be tear-drop shaped in some embodiments of the subject mattress technology. Such maternity mattress system preferably further comprises a set of a plurality of inserts for each of the openings in the foam mattress supplement, wherein each insert is characterized by respective upper and lower surfaces. The plurality of inserts may be selectively removed or added to increase or decrease the depth of each respective opening to more comfortably accommodate the abdomens of pregnant women.

The upper and lower surfaces of such mattress system, including such inserted modular plug's external surfaces (excluding the peripheries thereof), may have a surface treatment which generates a uniform series of upstanding projections or promontories with a generally flat apex surface. Each individual promontory may be surrounded by voids which allow for their individual compression.

In use, any embodiment of the present invention allows a patient (i.e., a pregnant woman) to selectively remove one or all of such modular plugs to alter the depth of such central opening to more comfortably accommodate and support her growing abdomen while she is resting in a prone position and throughout the term of her pregnancy.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
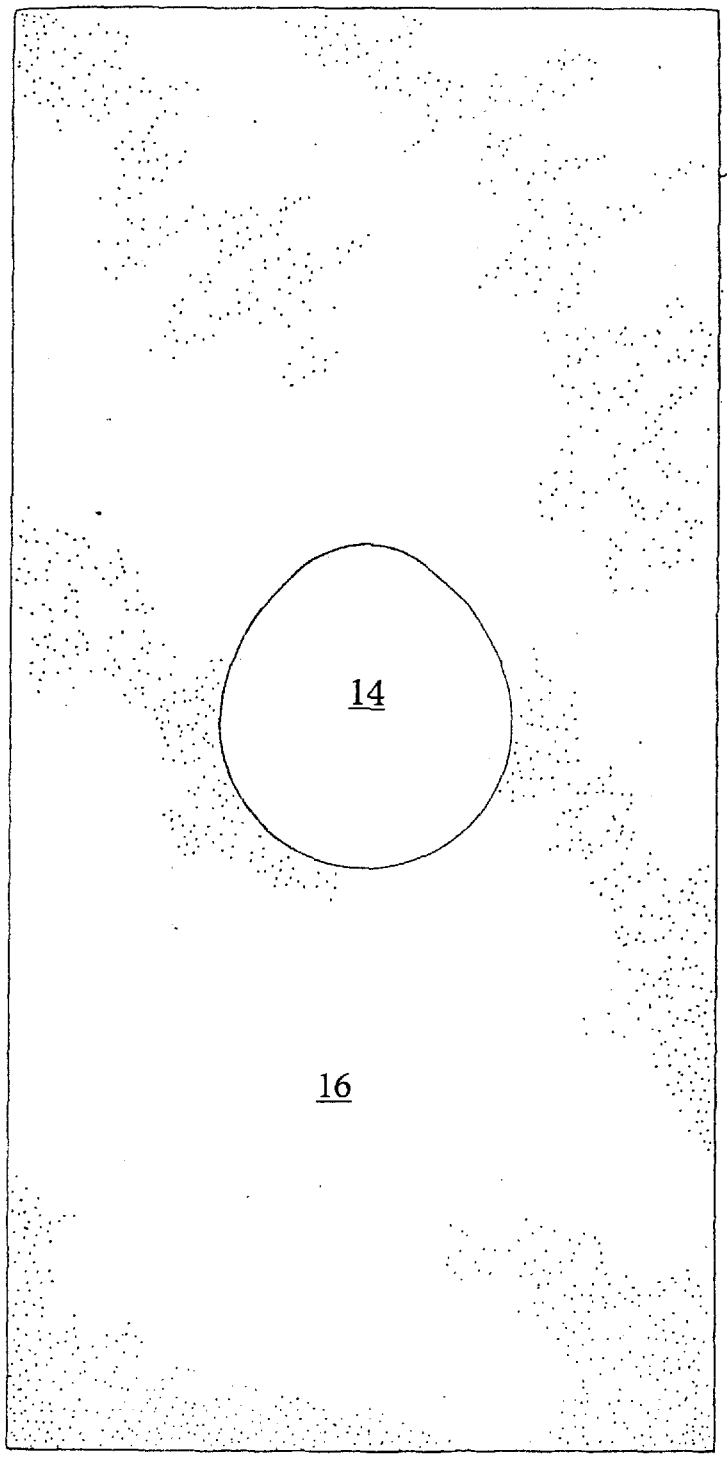
FIG. 1 is a top plan view of an embodiment of the present invention illustrating the central opening within the mattress of the modular maternity mattress system with the two modular plugs removed therefrom, such view in some embodiments being the identical view as the bottom plan view thereof.

Repeat use of reference characters throughout the present specification and appended drawings is intended to represent the same or analogous features or elements of the invention.

DETAILED DESCRIPTION OF THE PREFERRED EMBODIMENTS

Reference will now be made in detail to presently preferred embodiments of the invention, examples of which are fully represented in the accompanying drawings. Such examples are provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

As disclosed above, the present invention is particularly concerned with a simple, cost effective maternity mattress system with a generally teardrop shaped central opening and two modular plugs removably received therein for selectively altering the depth of the central opening during the term of the pregnancy, where the upper and lower surfaces of the main mattress portion and the exterior surfaces of the modular plugs may have a specific surface treatment to enhance the patient's comfort during use of the mattress. The functional aspects of the present invention are derived from but not inherent to the design characteristics filed in commonly owned U.S. Design Patent No. 411,933, incorporated fully herein by reference. FIG. 1 depicts the maternity mattress system 10 comprising a foam main mattress portion 12 with a central opening 14 of predetermined shape therein. In particular, the upper surface 16 of the main mattress portion 12 is shown.

One of ordinary skill in the art may recognize that any of the numerous well-known synthetic foam materials may be used for the present invention. Due to the delicate nature of the support being provided, however, certain support characteristics as defined by the foam material chosen are preferred.

One such support characteristic is the density (in pounds per cubic foot) of the foam selected. It is broadly preferred that the foam have a density in a range of from about 1.0 to about 2.0 pounds per cubic foot. It is more preferred that the foam utilized in the present invention have a foam density of 1.3±0.05 pounds per cubic foot to achieve a generally non-crushable surface capable of providing support for the user (i.e., a pregnant woman) without being considered uncomfortable.

Another support characteristic of the foam material selected is the indentation load deflection (ILD) characteristic. The ILD of a material may be defined as the number of pounds of pressure required to push a fifty square inch circular plate into a sample of the material a given percentage deflection thereof. For example, a twenty-five percent ILD of thirty pounds would mean that thirty pounds of pressure is required to push a fifty inch circular plate into a four inch thick piece of the selected foam material a distance of one inch (i.e., twenty-five percent of the original unloaded thickness). It is desired that the foam utilized in the present invention have a twenty-five percent ILD of between about twenty-seven and about thirty-three pounds to achieve a sufficiently sturdy supportive surface without being considered uncomfortable. Some embodiments may include variations to such range.

Similarly, one of ordinary skill in the art may recognize that various shapes may be used for such central opening 14 within such main mattress portion 12. It is preferred, however, that a teardrop shaped opening 14 as illustrated be used. Such a teardrop shape conforms better because it mimics the shape of a pregnant woman's abdomen. This allows such central opening 14 and main mattress portion 12 to provide the support necessary to result in a more comfortable resting position throughout the term of the pregnancy for the patient.

Figure 2:
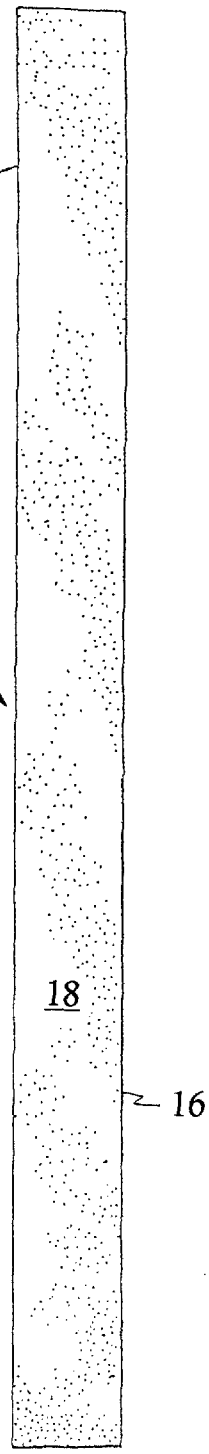
FIG. 2 is a left-side plan view of the embodiment of the present invention shown in FIG. 1, such view being the identical view as the right-side plan view thereof.

FIG. 2 depicts the left side plan view of a preferred embodiment of the present invention. In particular, FIG. 2 illustrates an embodiment where no surface treatment has been applied to either the upper surface 16 or the lower surface of the main mattress portion 12 of the mattress system 10. U.S. Pat. Nos. 4,603,445 and 4,686,725, incorporated fully herein by reference, show various surface treatments on either the upper or lower surface or on both referenced surfaces of a mattress having individually compressible promontories as will be discussed further hereafter.

Figure 3:
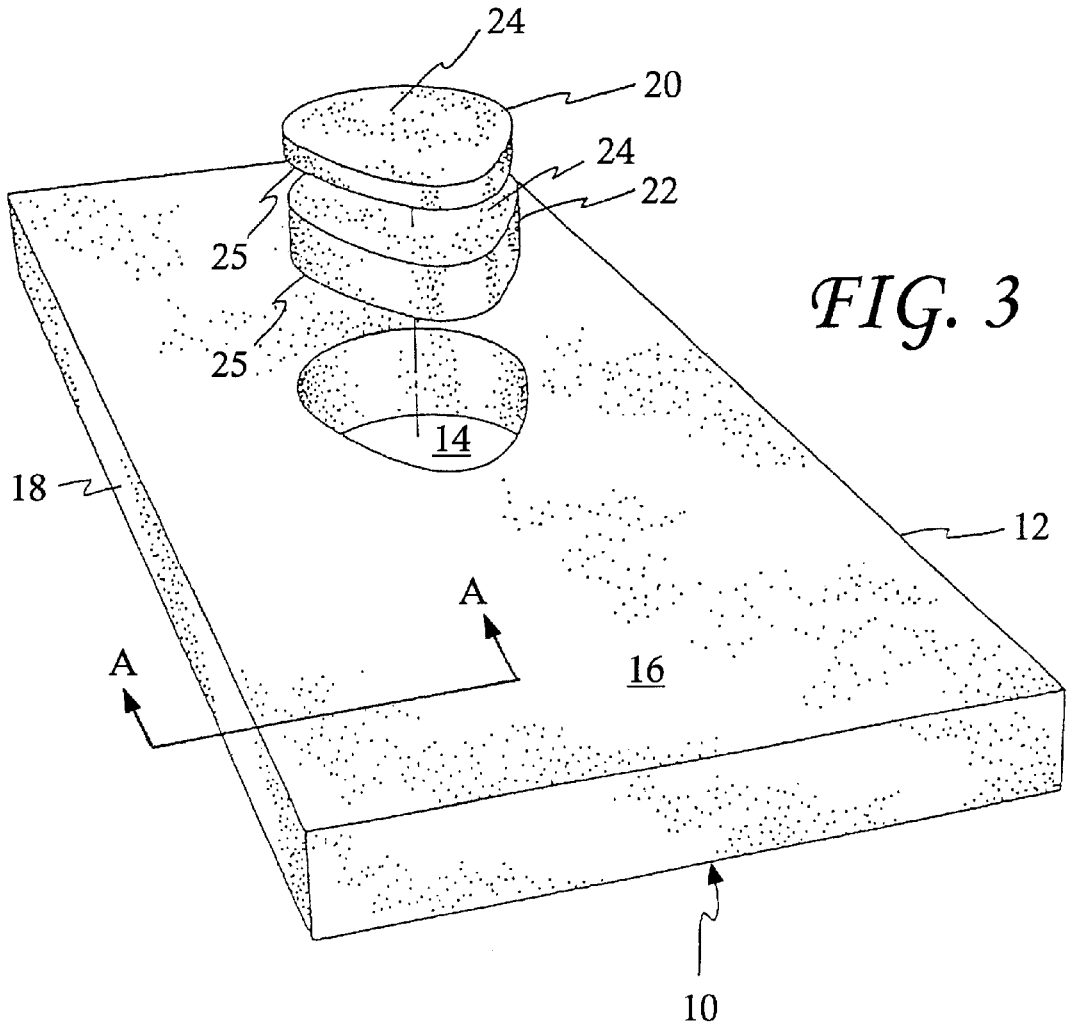
FIG. 3 is a perspective view of the embodiment of the present invention shown in FIG. 1, with the two modular plugs positioned in exploded view relative to the mattress central opening therefore.
Figure 4:
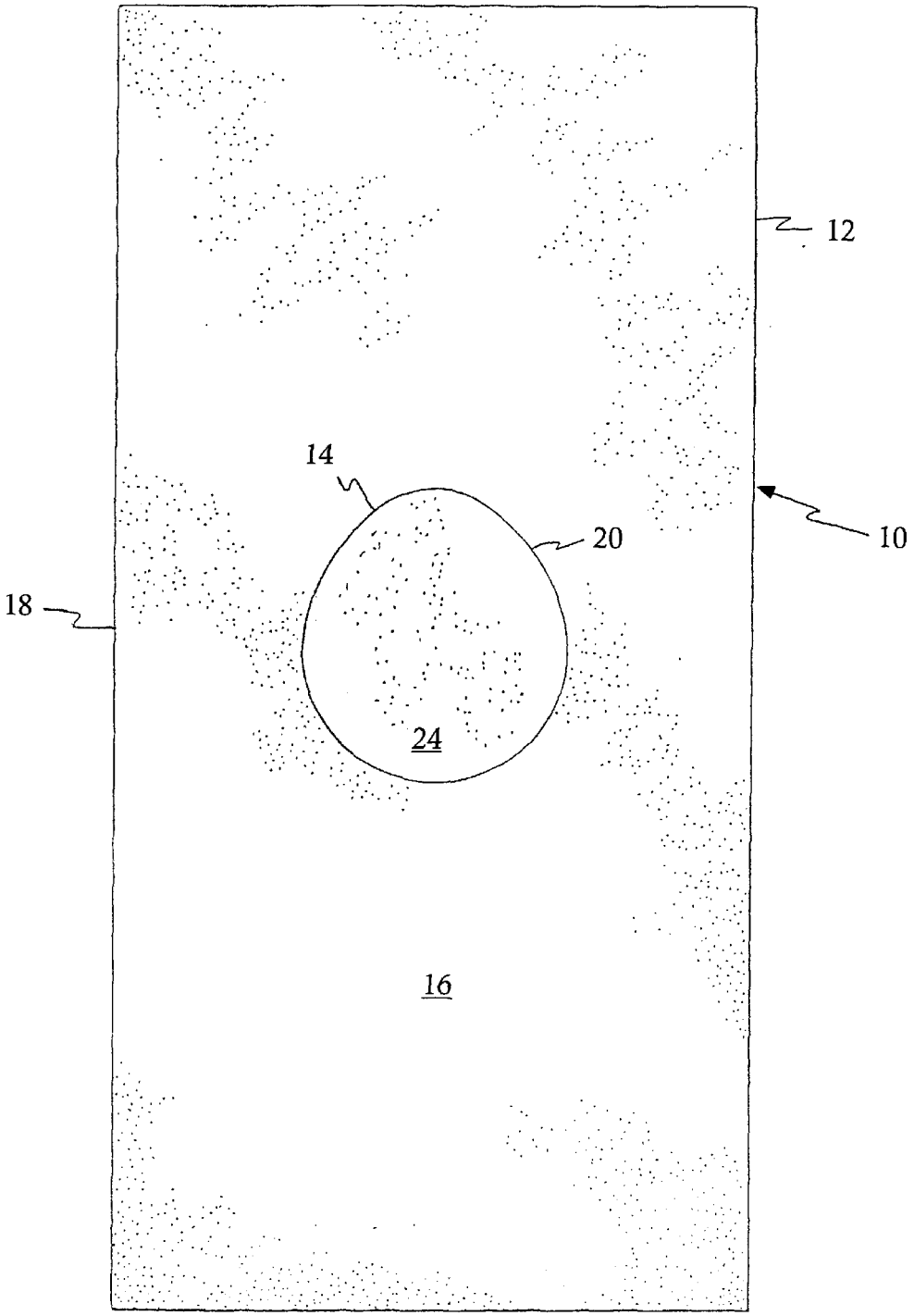
FIG. 4 is a front plan view of the embodiment of the present invention shown in FIG. 1, with the two modular plugs of present FIG. 3 received in the central opening thereof.

The preferred mattress system 10 is further shown in FIGS. 3 and 4. FIG. 3 illustrates a partially exploded view depicting the main mattress portion 12 with its central opening 14 therein and at least two modular plugs 20 and 22 for removable receipt in such central opening 14 as indicated. FIG. 4 illustrates the mattress system 10 wherein the modular plugs 20 and 22 are disposed within the central opening 14 in said main mattress portion 12.

Such modular plugs 20 and 22 are preferably of differing thicknesses to allow for variable combinations and the resulting variation in depth of such central opening 14 needed to allow use of such mattress system 10 throughout the full term of the pregnancy. For example, a patient may begin using such mattress system 10 when she learns that she is pregnant. As her abdomen begins to grow during her pregnancy, she may first remove modular plug 20 (the less thick of the two plugs) for greater comfort during sleep. As her abdomen continues to grow, she may next remove modular plug 22 and replace it with modular plug 20 allowing for even greater depth of the central opening 14 while retaining sufficient support for her abdomen.

Figure 6:
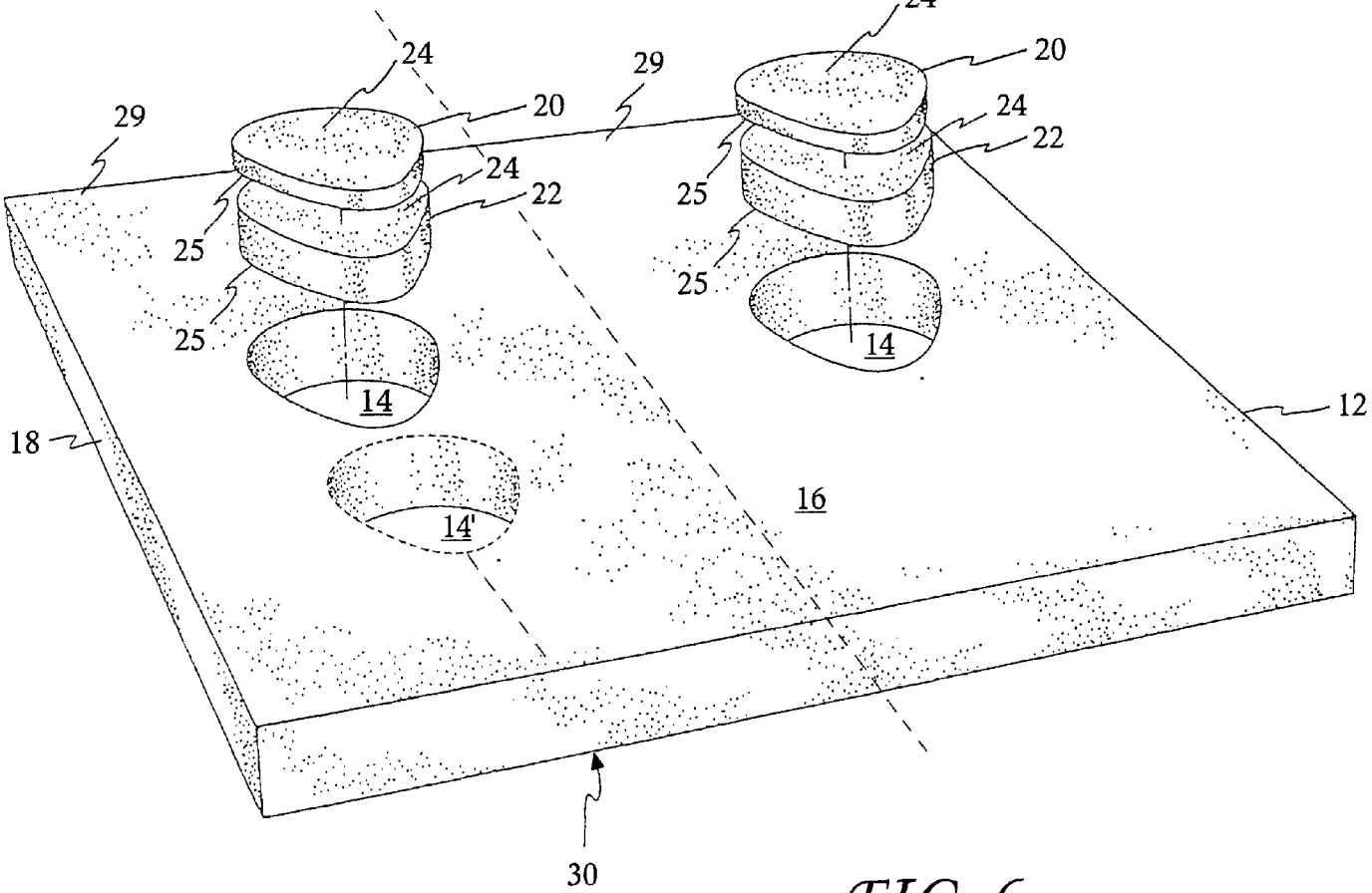
FIG. 6 is a perspective view of an additional embodiment of the present invention characterized by a plurality of openings and illustrated with respective exemplary modular plugs provided in a partially exploded position relative to such plurality of openings.

An additional embodiment of the present technology is depicted in FIG. 6 and described hereafter with respect to an exemplary mattress system embodiment 30. Mattress system 30 is designed with a plurality of openings, such that a pregnant woman or women may selectively lay in a prone position in various of such openings. A main foam mattress supplement portion 12 is characterized by an upper surface 16 and lower surface (not shown) as well as side surfaces, such as 18, which define a thickness of the foam mattress supplement. The foam mattress supplement 12 may be further formed to define a plurality of openings 14 therethrough. Such openings 14 may be generally tear-drop shaped in some instances.

A plurality of openings may be provided in a single longitudinal axis (such as exemplary openings 14 and 14') of FIG. 6. By providing multiple openings in a single position, more versatile positioning of a pregnant woman's abdomen is facilitated. Such configuration may be especially advantageous in accomodating women of varied height. Alternatively, when the mattress is designed with a longitudinal axis defining lateral halves 29 of the mattress, each of the plurality of openings 14 may be centrally located in one of said respective lateral halves 29 of mattress supplement 12. Such alternative configuration may be advantageous when in some instances it is desired to sleep on one side of a bed and in different circumstances it is desired to sleep on the other side.

The exemplary maternity mattress 30 of FIG. 6 may further include a set of at least two inserts, or modular plugs 20 and 22, for each of the openings 14. Each set of inserts may correspond to two inserts 20 and 22 of differing thickness, although it should be appreciated that a greater or fewer number of inserts may be included for each set of inserts per opening 14. Individual ones of the inserts 20 and 22 may be selectively removed or added to respective openings 14 such that the depth of each respective opening 14 is increased or decreased as desired to accommodate the comfort of pregnant women. Each insert 20,22 is defined as having an upper surface 24 and lower surface 25. Selected surfaces of the mattress supplement portion 12 as well as selected upper surfaces 24 and lower surfaces 25 of the inserts may feature a surface treatment such as described with respect to FIG. 5.

With further reference to the exemplary maternity mattress 30 of FIG. 6, it should be appreciated that the foam material used in mattress supplement portion 12 as well as inserts 20 and 22 may in some embodiments feature support characteristics designed to achieve a sufficiently sturdy supportive surface without being considered too uncomfortable. Such support characteristics may correspond in some embodiments to a foam density within a range from about 1.0 to about 2.0 pounds per cubic foot, or more specifically a foam density of about 1.3±0.05 pounds per cubic foot. In other embodiments, the mattress supplement and inserts may each have a 25% indentation load deflection characteristic falling in a range of about 27 to about 33 pounds.

Although several exemplary embodiments of the present technology have been described using specific terms and devices, such description is for illustrative purposes only. The words used are words of description rather than of limitation. It is to be understood that changes and variations may be made by those of ordinary skill in the art without departing from the spirit or the scope of the present subject matter. In addition, it should be understood that aspects of various other embodiments may be interchanged both in whole or in part. Therefore, the spirit and scope of the present subject matter should not be limited to the description of the preferred versions contained herein.

Figure 5:
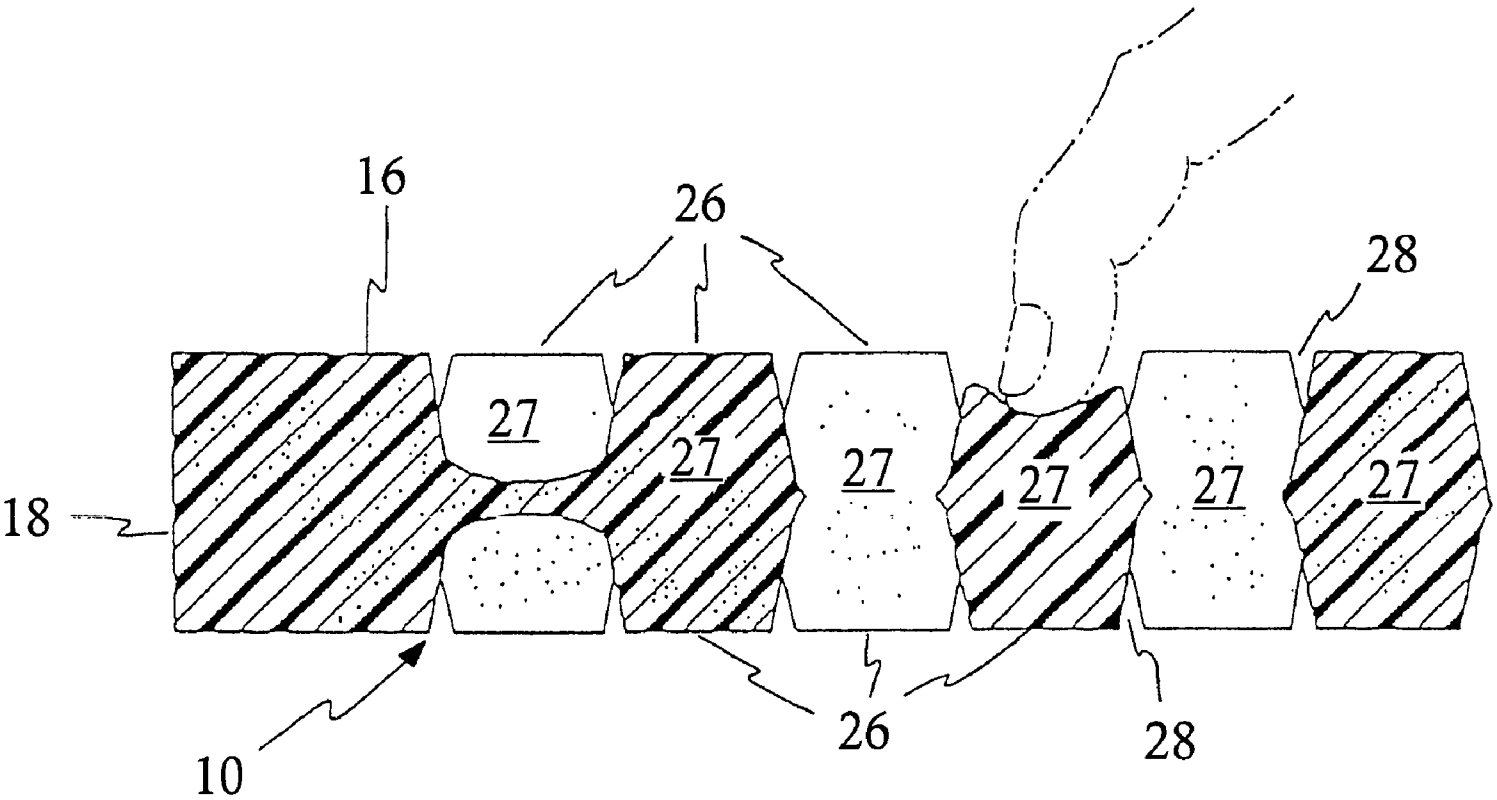
FIG. 5 is a partial cross-sectional view taken along line A—A of FIG 3, illustrating an alternative embodiment of the present invention including a textured surface for both the main mattress portion and/or the modular plugs therein comprising individually compressible promontories with generally flat apex surfaces.

FIG. 5 illustrates just one of several possible surface treatments for use with the preferred embodiment of the present invention. In particular, the surface treatment shown includes a textured surface for both the main mattress portion 12 and the modular plug's external surfaces 24 and 25. Such textured surface includes individually compressible promontories 27 with generally flat apex surfaces 26. Generally, in accordance with the subject invention, the promontories 27 are to a degree independent of each other, for improved resilient support. Each promontory 27 in this particular example is surrounded by voids 28 which separate it from the surrounding foam material to allow for individual compression. In another embodiment, the promontories (i.e., support projections) joined adjacent bases and/or curved or rounded top surfaces, such as the promontories of U.S. Pat. No. 4,686,725. The curved peripheries of the modular plugs 20 and 22 would preferably not have the surface texture but may have a smooth contour and have a curvature to mate with the central opening 14. One of ordinary skill in the art may recognize that such a surface treatment need not be present on both sides of the main mattress portion 12 or the modular plugs 20 and 22 but may be present on only one side of the main mattress portion 12 and/or one side of the modular plugs 20 and 22 or any combination thereof.

Although a preferred embodiment of the invention has been described using specific terms and devices, such description is for illustrative purposes only. The words used are words of description rather than of limitation. It is to be understood that changes and variations may be made by those of ordinary skill in the art without departing from the spirit or the scope of the present invention. In addition, it should be understood that aspects of various other embodiments may be interchanged both in whole or in part. Therefore, the spirit and scope of the present invention should not be limited to the description of the preferred versions contained herein.

What is claimed is:

1. A maternity mattress suitable for use by a pregnant woman, said mattress comprising:

a foam mattress supplement having upper and lower surfaces, a defined thickness and a central opening therethrough; and a plurality of inserts for said central opening each having upper and lower surfaces, wherein said plurality of inserts together equal said defined thickness of said mattress supplement;

whereby said pregnant woman may selectively remove or add individual ones of said plurality of inserts to increase or decrease the depth of said central opening to more comfortably accommodate their abdomen; and wherein said mattress supplement and said plurality of inserts each have a foam density falling in a range from about 1.0 to about 2.0 pounds per cubic foot.

2. A maternity mattress as set forth in claim 1, wherein said plurality of inserts comprise two foam inserts of differing thickness.

3. A maternity mattress as set forth in claim 1, wherein said mattress supplement and said plurality of inserts each have a foam density of about 1.3±0.05 pounds per cubic foot.

4. A maternity mattress suitable for use by a pregnant woman, said mattress comprising:

a mattress supplement having upper and lower surfaces, a defined thickness and a generally tear-drop shaped central opening therethrough; and at least two inserts for said central opening each having upper and lower surfaces;

whereby said pregnant woman may selectively remove or add individual ones of said at least two inserts to increase or decrease the depth of said central opening to more comfortably accommodate their abdomen; and wherein said mattress and said at least two inserts comprise foam members, wherein said at least two inserts are of differing thickness.

5. A maternity mattress as set forth in claim 4, wherein said mattress further comprises a longitudinal axis defining lateral halves of the mattress, and wherein said opening is centrally located in one of said lateral halves of said mattress.

6. A maternity mattress as set forth in claim 5, wherein said mattress is reversible so as to transpose the location of the opening about said longitudinal axis.

7. A maternity mattress suitable for use by a pregnant woman, said mattress comprising:

a foam mattress supplement having upper and lower surfaces, a defined thickness and a central opening therethrough; and a plurality of inserts for said central opening each having upper and lower surfaces, wherein said plurality of inserts together equal said defined thickness of said mattress supplement;

whereby said pregnant woman may selectively remove or add individual ones of said plurality of inserts to increase or decrease the depth of said central opening to more comfortably accommodate their abdomen; and wherein said mattress supplement and said plurality of inserts each have a 25% indentation load deflection characteristic falling in a range of about 27 to about 33 pounds, where said characteristic is defined by the number of pounds of pressure required to push a 50 square inch circular plate into said foam so as to compress same by 25% of said defined thickness.

8. A maternity mattress suitable for use by a pregnant woman, said mattress comprising:

a foam mattress supplement having upper and lower surfaces, a defined thickness and a central opening therethrough; and a plurality of inserts for said central opening each having upper and lower surfaces, wherein said plurality of inserts together equal said defined thickness of said mattress supplement;

whereby said pregnant woman may selectively remove or add individual ones of said plurality of inserts to increase or decrease the depth of said central opening to more comfortably accommodate their abdomen; and wherein said mattress has a surface treatment, said surface treatment limited to said upper surface of said mattress supplement, said surface treatment comprising a plurality of discrete upstanding projections with voids therebetween, wherein said projections have a generally flat apex and are independently compressible.

9. A maternity mattress suitable for use by a pregnant woman, said mattress comprising:

a foam mattress supplement having upper and lower surfaces, a defined thickness and a central opening therethrough; and a plurality of inserts for said central opening each having upper and lower surfaces, wherein said plurality of inserts together equal said defined thickness of said mattress supplement;

whereby said pregnant woman may selectively remove or add individual ones of said plurality of inserts to increase or decrease the depth of said central opening to more comfortably accommodate their abdomen; and wherein said mattress has a surface treatment, said surface treatment limited to said upper surface of each of said plurality of inserts and comprising a plurality of discrete upstanding projections with voids therebetween, wherein said projections have a generally flat apex and are independently compressible.

10. A maternity mattress as set forth in claim 4, wherein said mattress supplement and said at least two inserts each have a foam density falling in a range from about 1.0 to about 2.0 pounds per cubic foot.

11. A maternity mattress as set forth in claim 4, wherein said mattress supplement and said at least two inserts each have a foam density of about 1.3±0.05 pounds per cubic foot.

12. A maternity mattress as set forth in claim 4, wherein said mattress supplement and said at least two inserts each have a 25% indentation load deflection characteristic falling in a range of about 27 to about 33 pounds, where said characteristic is defined by the number of pounds of pressure required to push a 50 square inch circular plate into said foam so as to compress same by 25% of said defined thickness.

13. A maternity mattress as set forth in claim 4, wherein said mattress has a surface treatment on said upper surface of said mattress supplement that comprises a plurality of discrete upstanding projections with voids therebetween, wherein said projections have a generally flat apex and are independently compressible.

14. A maternity mattress as set forth in claim 4, wherein said mattress has a surface treatment on said upper surface of each of said plurality of inserts that comprises a plurality of discrete upstanding projections with voids therebetween, wherein said projections have a generally flat apex and are independently compressible.

15. A maternity mattress suitable for use by a plurality of pregnant women, said mattress comprising:

a foam mattress supplement having upper and lower surfaces, a defined thickness and a plurality of generally tear-drop shaped openings therethrough;

a set of a plurality of inserts for each of said openings each of said inserts having upper and lower surfaces; and whereby each of said plurality of pregnant women may selectively remove or add individual ones of said plurality of inserts to increase or decrease the depth of a respective one of said openings to more comfortably accommodate their abdomen.

16. A maternity mattress as set forth in claim 15, wherein said mattress further has a longitudinal axis defining lateral halves of the mattress.

17. A maternity mattress as set forth in claim 15, wherein each of said plurality of openings is centrally located in one of said lateral halves of said mattress.

18. A maternity mattress as set forth in claim 15, wherein each of said sets of a plurality of inserts comprises two foam inserts of differing thickness.

19. A maternity mattress as set forth in claim 15, wherein said mattress supplement and said inserts each have a foam density falling in a range from about 1.0 to about 2.0 pounds per cubic foot.

20. A maternity mattress as set forth in claim 15, wherein said mattress supplement and said inserts each have a foam density of about 1.3±0.05 pounds per cubic foot.

21. A maternity mattress as set forth in claim 15, wherein said mattress supplement and said inserts each have a 25% indentation load deflection characteristic falling in a range of about 27 to about 33 pounds, where said characteristic is defined by the number of pounds of pressure required to push a 50 square inch circular plate into said foam so as to compress same by 25% of said defined thickness.

22. A maternity mattress as set forth in claim 15, wherein said mattress has a surface treatment.

23. A maternity mattress as set forth in claim 22, wherein said surface treatment is limited to said upper surface of said mattress supplement and comprises a plurality of discrete upstanding projections with voids therebetween, wherein said projections have a generally flat apex and are independently compressible.

24. A maternity mattress as set forth in claim 22, wherein said surface treatment is limited to said upper surface of each of said inserts and comprises a plurality of discrete upstanding projections with voids therebetween, wherein said projections have a generally flat apex and are independently compressible.

* * * * *